US009180659B1

(12) United States Patent
Condello

(10) Patent No.: US 9,180,659 B1
(45) Date of Patent: Nov. 10, 2015

(54) AQUEOUS TRANSFIX BLANKET DESIGN USING SCREEN GEOMETRY

(71) Applicant: XEROX CORPORATION, Norwalk, CT (US)

(72) Inventor: Anthony S. Condello, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/458,788

(22) Filed: Aug. 13, 2014

(51) Int. Cl.
*B41J 2/01* (2006.01)
*B41J 2/005* (2006.01)

(52) U.S. Cl.
CPC ..... *B41J 2/0057* (2013.01)

(58) Field of Classification Search
CPC ..... B41J 2/0057; B41J 2/01; B41J 2/17593; B41J 29/17; B41J 2002/012
USPC ..... 347/103
See application file for complete search history.

(56) References Cited

U.S. PATENT DOCUMENTS

| | | | | |
|---|---|---|---|---|
| 6,263,183 | B1 * | 7/2001 | Schlueter et al. | 399/329 |
| 2005/0270351 | A1 * | 12/2005 | Mouri et al. | 347/103 |
| 2007/0126851 | A1 * | 6/2007 | Yamazaki | 347/233 |
| 2009/0226224 | A1 * | 9/2009 | Takahashi | 399/313 |
| 2014/0168330 | A1 | 6/2014 | Liu et al. | |
| 2014/0168336 | A1 | 6/2014 | Mettu et al. | |

OTHER PUBLICATIONS

Brynn Dooley et al., "Infrared Reflective Pigments in a Transfix Blanket in a Printer", U.S. Appl. No. 14/180,829, filed Feb. 14, 2014.

* cited by examiner

*Primary Examiner* — Manish S Shah
*Assistant Examiner* — Yaovi Ameh
(74) *Attorney, Agent, or Firm* — MH2 Technology Law Group LLP

(57) ABSTRACT

An aqueous transfix blanket and a printer including the aqueous transfix blanket. The aqueous transfix blanket includes a screen layer including a plurality of mesh wires that define a plurality of spaces between the plurality of mesh wires. The aqueous transfix blanket further includes a first layer that overlies the screen layer and a second layer that underlies the screen layer, wherein the plurality of spaces provide a plurality of air gaps between the first layer overlying the screen layer and the second layer underlying the screen layer.

13 Claims, 3 Drawing Sheets

AQUEOUS TRANSFIX BLANKET DESIGN USING SCREEN GEOMETRY

TECHNICAL FIELD

The present teachings relate to the field of inkjet aqueous transfix devices and, more particularly, to transfer members for inkjet aqueous transfix devices.

BACKGROUND

Inkjet printing processes can include the use of a liquid ink jetted from a printhead through a plurality of nozzles. The ink can be jetted directly onto a print medium such as paper, plastic, or textile. In an aqueous transfix process, a water-based ink can be jetted directly onto a surface of an intermediate transfer member such as a rotating belt or drum, or onto a sacrificial coating, such as a polyurethane coating, applied to the intermediate transfer member. After the ink is jetted, the ink is transferred through pressure from a pressure roll, and physical contact between the ink and the print medium at a transfix nip, from the surface of the intermediate transfer member to a surface of the print medium.

While jetting of the ink onto the intermediate transfer member typically occurs at a jetting viscosity, a better transfer of the ink from the intermediate transfer member to the print medium may be realized if the ink viscosity at the point of transfer is higher than the jetting viscosity. Thus a printer employing an aqueous transfix process typically includes infrared heaters to heat the ink after the ink is jetted onto the intermediate transfer member but before it is transferred to the print medium to remove a desired amount of solvent (i.e., water) from the ink. While some drying is preferred, the heating is carefully controlled to ensure that the ink is not excessively dried, which would degrade the transfer of the ink to, and bonding of the ink with, the print medium.

The surface of the intermediate transfer member should have various physical, chemical, and thermal properties so that the ink is properly transferred to the print medium. The intermediate transfer member is typically designed so that its outer surface retains as much of the thermal energy output from the heaters as possible to improve control of the ink viscosity. If heat is transferred deeper to the inner layers of the intermediate transfer belt, viscosity control of the ink becomes more challenging, for example because it becomes more difficult to estimate the amount of heat transferred to the ink, and thus the amount the ink is dried, compared to the amount of heat retained by the intermediate transfer member. Ideally, thermal energy from the printer heaters would be retained only in the outer surface of the intermediate transfer member.

Further, the surface energy of the intermediate transfer member should be sufficient to reduce the spread of ink across the intermediate transfer member before it is transferred to the print medium. The surface of the intermediate transfer member should also be flexible, non-compressible, and sufficient to release the ink to the print medium at the transfix nip.

An intermediate transfer member can include a silicone layer outer surface or "transfix blanket" that is adhered to a stainless steel substrate with an adhesive. The stainless steel substrate can, in turn, be wrapped around an aluminum drum. The silicone layer outer surface can optionally include fillers in an attempt to improve heat retention for ink drying and surface energy for ink release and transfer. The intermediate transfer member may also include a foam layer underlying the silicone layer to provide a thermal insulation layer to reduce heat transfer to the underlying stainless steel layer.

While the foam layer may improve thermal properties of the intermediate transfer member, it may also increase compressibility of the silicone surface during contact with the pressure roll at the transfix nip, which is typically to be avoided.

An intermediate transfer member design having an improved heat retention at the outer surface and which is sufficiently non-compressible would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an embodiment, an aqueous transfix blanket may include a screen layer having a plurality of mesh wires that define a plurality of spaces between the plurality of mesh wires, a first layer overlying the screen layer, and a second layer underlying the screen layer, wherein the plurality of spaces provide a plurality of air gaps between the first layer overlying the screen layer and the second layer underlying the screen layer.

In another embodiment, an aqueous transfix printer may include an aqueous transfix blanket. The aqueous transfix blanket may include a screen layer comprising a plurality of mesh wires that define a plurality of spaces between the plurality of mesh wires, a first layer overlying the screen layer, and a second layer underlying the screen layer, wherein the plurality of spaces provide a plurality of air gaps between the first layer overlying the screen layer and the second layer underlying the screen layer. The aqueous transfix printer may further include a transfix roller and a transfix nip at an interface between the aqueous transfix blanket and the transfix roller.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc. Unless otherwise specified, the word "polymer" encompasses any one of a broad range of carbon-based compounds formed from long-chain molecules including thermoset polyimides, thermoplastics, resins, polycarbonates, epoxies, and related compounds known to the art.

An embodiment of the present teachings can provide an intermediate transfer member for use in an aqueous transfix printer that has better heat retention in the outer surface and reduced transfer of heat to underlying layer such as an underlying stainless steel layer compared to some conventional intermediate transfer members.

Figure 1A:
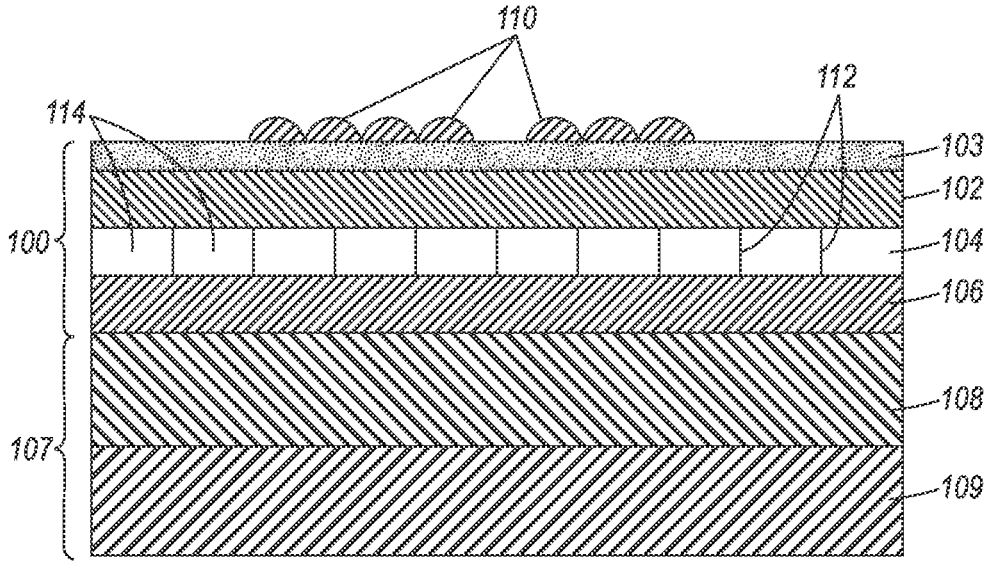
FIG. 1A depicts a schematic cross-sectional view of an illustrative transfix blanket for a printer, according to one or more embodiments disclosed.
Figure 1B:
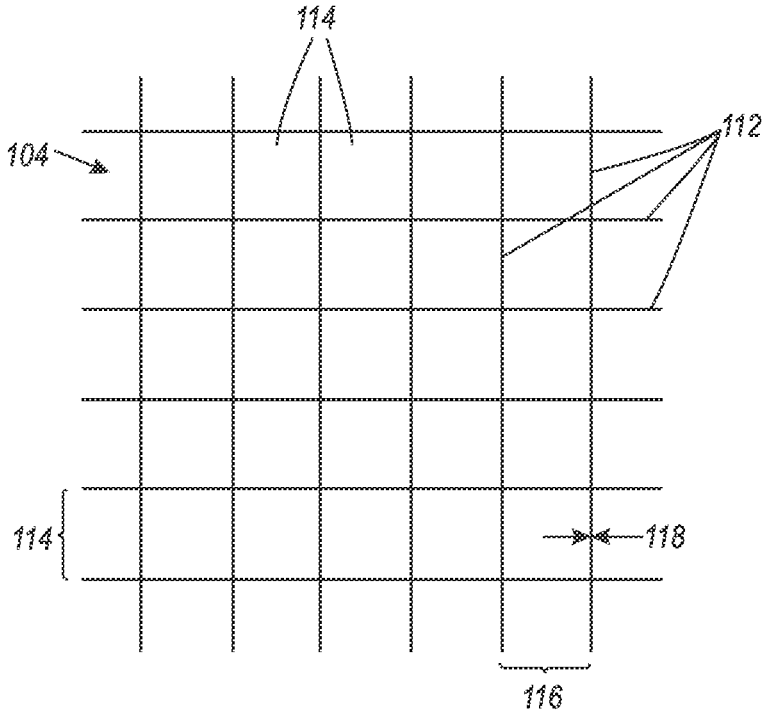
FIG. 1B depicts a schematic plan view of an illustrative screen layer that forms a portion of the FIG. 1A transfix blanket.

An embodiment of an aqueous transfix print blanket according to the present teachings is depicted in FIGS. 1A and 1B. The aqueous transfix blanket 100 may be a subassembly of a printer. It will be appreciated the FIGS. represent generalized schematic illustrations where other structures may be added and existing structures may be removed or modified.

FIG. 1A is a cross section depicting a section of the aqueous transfix blanket 100. The aqueous transfix blanket 100 may include an outer conforming layer 102, an intermediate mesh or screen layer 104, and an inner polymer layer 106.

Optionally, the outer conforming layer 102 may have formed thereon at least one deposited layer 103. In an embodiment, the deposited layer 103 may be a spread layer such as a synthetic rubber and fluoropolymer elastomer (i.e., fluoro rubber), for example Viton® (available from DuPont), or an FKM material (as defined by American Society for Testing and Materials (ASTM) standards D1418). The deposited layer 103 may be used to spread and/or wet the ink to assist in the release of the ink from the deposited layer 103 during and/or after ink transfer, and ink byproducts and other contaminants from the surface of the belt or roll during cleaning. The deposited layer 103 may also be more durable than the conforming layer 102, thereby increasing the lifetime of the belt or roll 300. The synthetic rubber and fluoropolymer elastomer deposited layer 103 can provide a good balance of wetting and release, and is durable to resist wear from, for example, contact with a print medium or other printer surfaces. If the conforming layer 102 has suitable wetting and release properties, and is suitably durable against wear, a separate deposited layer 103 may not be necessary.

FIG. 1A depicts the aqueous transfix blanket 100 during use, and thus further depicts the aqueous transfix blanket 100 attached to a rigid underlayer 107 and an aqueous ink layer 110. The rigid underlayer 107 may include, for example, a stainless steel substrate 108 and an aluminum drum 109. The aqueous transfix blanket 100 is attached to the stainless steel substrate 108 which is, in turn, attached to the aluminum drum 109. The aqueous ink layer 110, as depicted, has been jetted over or onto the conforming layer 102 using, for example, the printer 200 depicted in FIG. 2 and described in detail below.

The conforming layer 102, which may be compressible, can include an elastomer such as silicone, a fluoro rubber such as Viton® (available from DuPont), ethylene propylene diene monomer (EPDM), nitrile rubber (i.e., acrylonitrile butadiene rubber or NBR), polyurethane, and combinations of two or more of these. The elastomer outer layer may have a thickness of from about 20 micrometers (μm) to about 5,000 μm, or from about 40 μm to about 2,500 μm, or from about 100 μm to about 1,000 μm.

The screen layer 104, which is depicted in cross section in FIGS. 1A and 1*n* plan view in FIG. 1B, is interposed between the conforming layer 102 and the polymer layer 106. The screen layer 104 includes a plurality of mesh wires 112 that define a plurality of spaces 114 therebetween. In FIG. 1B, the mesh wires 112 are arranged in a symmetrical square grid pattern, although a rectangular grid pattern, a triangular grid pattern, a pentagonal grid pattern, etc., both symmetrical and asymmetrical, are also contemplated. The mesh wires 112 of the screen layer 104 may include a material such as fiberglass, carbon fiber, a para-aramid synthetic fiber such as Kevlar® (available from E. I. DuPont de Nemours, Inc. of Wilmington, Del., hereinafter, DuPont™), a meta-aramid material such as Nomex® (available from DuPont), a metal, a metal alloy, etc. It will be understood that the mesh wires may be formed by molding a molten material which is then solidified to form the plurality of mesh wires 112 and plurality of spaces 114, punching a solid sheet of material with a die or other cutter to form the plurality of spaces 114, by using a plurality of separate and individual mesh wires 112, etc.

While FIG. 1B depicts six horizontal mesh wires 112 and six vertical mesh wires 112 for a section of a screen layer, it will be appreciated that a screen layer 104 may have any number of mesh wires 112 depending on the size of the aqueous transfix blanket 100 and the spacing between each wire 12. In an embodiment for a screen layer having a square pattern, a pitch of the mesh wires (i.e., a distance between corresponding points on adjacent mesh wires) may be from about 1.0 millimeter (mm) to about 3.0 mm, or from about 1.5 mm to about 2.5 mm, or about 2.0 mm in both a vertical direction (Y-direction) 114 and a horizontal direction 116 (X-direction). Each mesh wire may have a thickness 118 of from about 150 μm to about 350 μm, or from about 200 μm to about 300 μm, or about 250 μm.

The polymer layer 106 may include a polymer such as polyimide, a biaxially oriented polyethylene terephthalate polyester resin film such as Mylar® (available from DuPont), polyester, and combinations of two or more of these. The inner polymer layer may have a thickness of from about 60 μm to about 100 μm, or from about 70 μm to about 90 μm, or about 80 μm.

The screen layer 104 can be attached to the conforming layer 102 using, for example, a thin double-sided, high temperature adhesive tape or film (not individually depicted for simplicity), or by molding the conforming layer 102 in place; the screen layer 104 can be similarly attached or molded to the polymer layer 106. Any adhesive used to attach the screen layer 104 to the conforming layer 102 and to the polymer layer 106 is selected so that the adhesive does not flow into the spaces 114 between the mesh wires 112, and the spaces 114, and to maintain an air gap, and more specifically a plurality of air gaps, between the conforming layer 102 and the polymer layer 106 as depicted in FIG. 1A.

As discussed above, an aqueous transfix blanket 100 should be designed so that its outer surface retains as much of the thermal energy output from the heaters as possible to improve control of the ink viscosity. An air gap 114 provided by the relatively fine screen layer 104 under the outer conforming layer 102 forms an effective thermal insulation which assists in retaining the heat within the conforming layer 102. For example, while silicone has a thermal conductivity of about 0.170 watts per meter kelvin (W/m·K), air has a thermal conductivity of about 0.024 W/m·K. The thermal insulation provided by the screen layer 104, and more specifically the air gap 114 in the screen layer 104, reduces the transfer of heat from the conforming layer 102 into deeper layers of the intermediate transfer member, such as the into the polymer layer 106 and the rigid underlayer 107, compared to conventional intermediate transfer members that have a silicone layer directly attached to a stainless steel underlayer. Reducing heat transfer helps maintain the surface temperature of the aqueous transfix blanket. Further, the air gap provided by the screen layer 104 does not significantly change the mechanical properties of the conforming layer 102, which are important for correctly transferring ink from the conforming layer 102 to the print medium, and fixing the ink to the print medium, at the transfix nip.

In an exemplary embodiment, the mesh wires 112 of the screen layer 104 may be formed from fiberglass, which has a thermal conductivity of about 0.04 W/m·K. While the fiberglass has a better thermal conductivity compared to silicone, it is a poorer thermal insulator than air. Generally, a screen layer 104 having a larger pitch between mesh wires 112 would provide a better thermal insulation than a screen layer having a smaller pitch between mesh wires 112. As the pitch becomes increasingly smaller, the thermal conductivity becomes closer to the material from which the screen is manufactured and further away from the thermal conductivity of air. However, if the pitch is excessively large, a silicone conforming layer 102 may collapse into the air gap 114 to physically contact the layer below the screen layer 104. Thus, for a screen layer having mesh wires 112 arranged in a symmetrical square grid pattern, a pitch at least within the range of about 1.0 mm to about 3.0 mm, or from about 1.5 mm to about 2.5 mm, or about 2.0 mm in both a vertical 114 and a horizontal 116 direction would be sufficient. Grid patterns having other shapes may be examined using the information herein to determine a sufficient mesh wire pitch.

Figure 2:
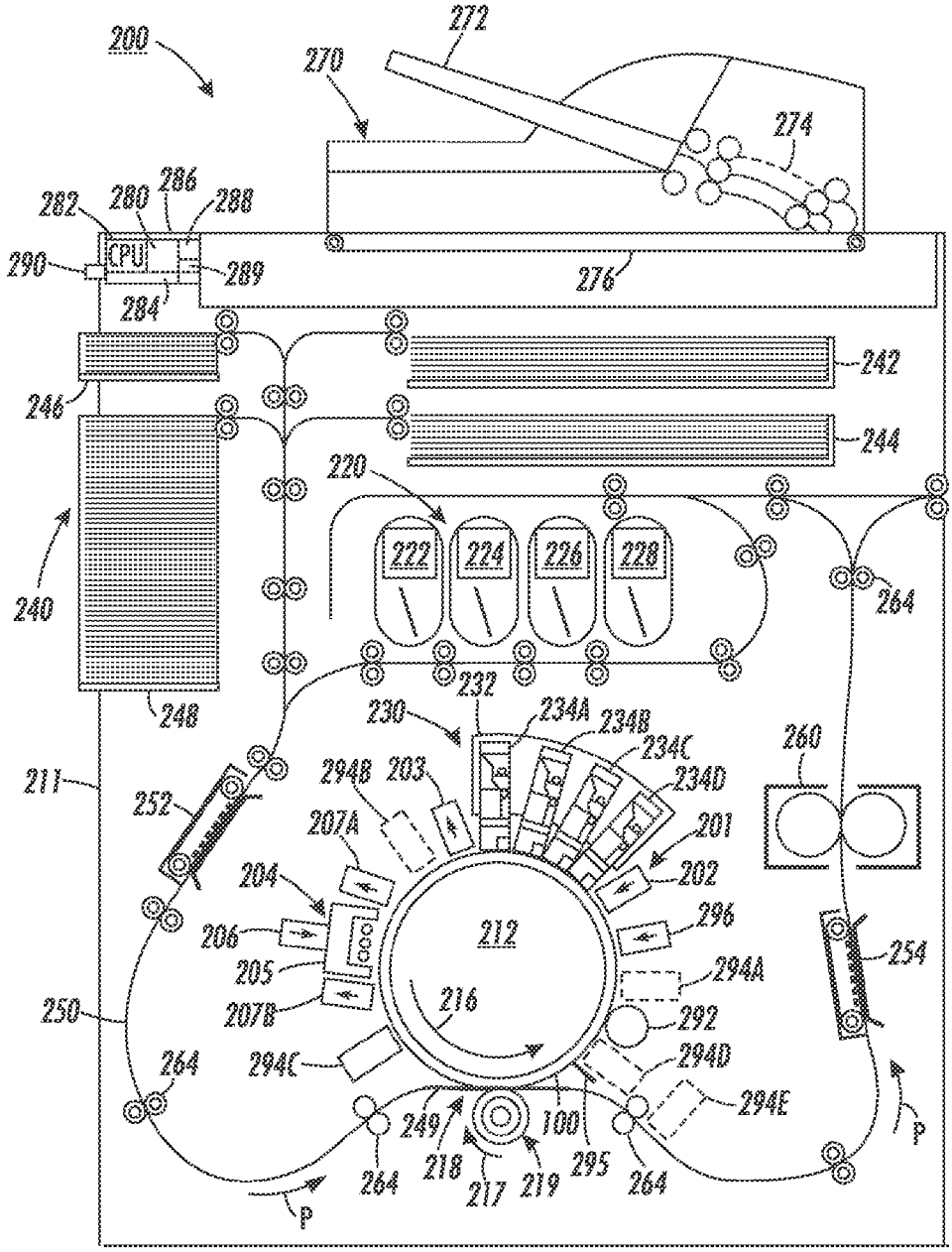
FIG. 2 depicts an illustrative printer including the transfix blanket, according to one or more embodiments disclosed.

FIG. 2 depicts an illustrative aqueous transfix printer 200 including the transfix blanket 100, according to one or more embodiments disclosed. The printer 200 may be an indirect aqueous inkjet printer that forms an ink image on a surface of the blanket 100. The blanket 100 may be mounted about an intermediate transfer member 212. The ink image may be transferred from the blanket 100 to media passing through a nip 218 formed between the blanket 100 and a transfix roller 219.

A print cycle is now described with reference to the printer 200. A "print cycle" refers to operations of the printer 200 including, but not limited to, preparing an imaging surface for printing, ejecting ink onto the imaging surface, treating the ink on the imaging surface to stabilize and prepare the image for transfer to media, and transferring the image from the imaging surface to the media.

The printer 200 may include a frame 211 that supports operating subsystems and components, which are described below. The printer 200 may also include an intermediate transfer member 212, which is illustrated as a rotating imaging drum. The intermediate transfer member 212 may have the blanket 100 mounted about the circumference of the intermediate transfer member 212. The blanket 100 may move in a direction 216 as the intermediate transfer member 212 rotates. The transfix roller 219 may rotate in the direction 217 and be loaded against the surface of blanket 100 to form the transfix nip 218, within which ink images formed on the surface of blanket 100 are transfixed onto a print medium 249. In some embodiments, a heater in the intermediate transfer member 212 or in another location of the printer heats the blanket 100 to a temperature in a range of, for example, approximately 40° C. to approximately 80° C. The elevated temperature promotes partial drying of the liquid carrier that is used to deposit the hydrophilic composition and the water in the aqueous ink drops that are deposited on the blanket 100.

A surface maintenance unit ("SMU") 292 may remove residual ink left on the surface of the blanket 100 after the ink images are transferred to the print medium 249. The SMU 292 may include a coating applicator, such as a donor roller (not shown), which is partially submerged in a reservoir (not shown) that holds a sacrificial hydrophilic polyurethane coating composition in a liquid carrier. The donor roller may rotate in response to the movement of the blanket 100 in the process direction. The donor roller may draw the liquid polyurethane composition from the reservoir and deposit a layer of the polyurethane composition on the blanket 100, which may be represented in FIG. 1 as sacrificial coating 103. As described below, the polyurethane composition may be deposited as a uniform layer having any desired thickness. After a drying process, the dried polyurethane coating may substantially cover a surface of the blanket 100 before the printer 200 ejects ink drops during a print process. The SMU 292 may be operatively connected to a controller 280, described in more detail below, to enable the controller 280 to operate the donor roller, as well as a metering blade and a cleaning blade to deposit and distribute the coating material onto the surface of the blanket 100 and to remove un-transferred ink and any polyurethane residue from the surface of the blanket 100.

The printer 200 may also include a dryer 296 that emits heat and optionally directs an air flow toward the polyurethane composition that is applied to the blanket 100. The dryer 296 may facilitate the evaporation of at least a portion of the liquid carrier from the polyurethane composition to leave a dried layer on the blanket 100 before the intermediate transfer member passes one or more printhead modules 234A-234D to receive the aqueous printed image.

The printer 200 may also include an optical sensor 294A, also known as an image-on-drum ("IOD") sensor, which is configured to detect light reflected from the blanket 100 and the polyurethane coating applied to the blanket 100 as the intermediate transfer member 212 rotates past the sensor. The optical sensor 294A includes a linear array of individual optical detectors that are arranged in the cross-process direction across the blanket 100. The optical sensor 294A generates digital image data corresponding to light that is reflected from the blanket 100 and the polyurethane coating. The optical sensor 294A generates a series of rows of image data, which are referred to as "scanlines," as the intermediate transfer member 212 rotates the blanket 100 in the direction 216 past the optical sensor 294A. In at least one embodiment, each optical detector in the optical sensor 294A may include three sensing elements that are sensitive to wavelengths of light corresponding to red, green, and blue (RGB) reflected light colors. In another embodiment, the optical sensor 294A may include illumination sources that shine red, green, and blue light. In yet another embodiment, the sensor 294A may have an illumination source that shines white light onto the surface of blanket 100, and white light detectors are used.

The optical sensor 294A may shine complementary colors of light onto the image receiving surface to enable detection of different ink colors using the photodetectors. The image data generated by the optical sensor 294A may be analyzed by the controller 280 or other processor in the printer 200 to identify the thickness of the polyurethane coating on the blanket 100. The thickness and coverage may be identified from either specular or diffuse light reflection from the blanket 100 and/or the coating. Other optical sensors 294B, 294C, and 294D may be similarly configured and located in different locations around the blanket 100 to identify and evaluate other parameters in the printing process, such as missing or inoperative inkjets and ink image formation prior to image drying (294B), ink image treatment for image transfer (294C), and the efficiency of the ink image transfer (294D). Alternatively, some embodiments may include an optical sensor to generate additional data that may be used for evaluation of the image quality on the media (294E).

The printer 200 may include an airflow management system 201, which generates and controls a flow of air through the print zone. The airflow management system 201 may include a printhead air supply 202 and a printhead air return 203. The printhead air supply 202 and return 203 may be operatively connected to the controller 280 or some other processor in the printer 200 to enable the controller to manage the air flowing through the print zone. This regulation of the air flow may be through the print zone as a whole or about one or more printhead arrays. The regulation of the air flow may help to prevent evaporated solvents and water in the ink from condensing on the printhead and as well as attenuating heat in the print zone to reduce the likelihood that ink dries in the inkjets, which may clog the inkjets. The airflow management system 201 may also include one or more sensors to detect humidity and temperature in the print zone to enable more precise control of the temperature, flow, and humidity of the air supply 202 and return 203 to ensure optimum conditions within the print zone.

The printer 200 may also include an aqueous ink supply and delivery subsystem 220 that has at least one source 222 of one color of aqueous ink. Since the printer 200 is a multicolor image producing machine, the ink delivery system 220 includes, for example, four (4) sources 222, 224, 226, 228, representing four (4) different colors CYMK (cyan, yellow, magenta, black) of aqueous inks.

The printhead system 230 may include a printhead support 232, which provides support for a plurality of printhead modules, also known as print box units, 234A-234D. Each printhead module 234A-234D effectively extends across the width of the blanket 100 and ejects ink drops onto the blanket 100. A printhead module 234A-234D may include a single printhead or a plurality of printheads configured in a staggered arrangement. Each printhead module 234A-234D may be operatively connected to a frame (not shown) and aligned to eject the ink drops to form an ink image on the coating on the blanket 100. The printhead modules 234A-234D may include associated electronics, ink reservoirs, and ink conduits to supply ink to the one or more printheads. One or more conduits (not shown) may operatively connect the sources 222, 224, 226, and 228 to the printhead modules 234A-234D to provide a supply of ink to the one or more printheads in the modules 234A-234D. As is generally familiar, each of the one or more printheads in a printhead module 234A-234D may eject a single color of ink. In other embodiments, the printheads may be configured to eject two or more colors of ink. For example, printheads in modules 234A and 234B may eject cyan and magenta ink, while printheads in modules 234C and 234D may eject yellow and black ink. The printheads in the illustrated modules 234A-234D are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 200 includes four printhead modules 234A-234D, each of which has two arrays of printheads, alternative configurations include a different number of printhead modules or arrays within a module.

After the printed image on the blanket 100 exits the print zone, the image passes under an image dryer 204. The image dryer 204 may include a heater, such as a radiant infrared heater, a radiant near infrared heater, and/or a forced hot air convection heater 205. The image dryer 204 may also include a dryer 206, which is illustrated as a heated air source, and air returns 207A and 207B. The infrared heater 205 may apply infrared heat to the printed image on the surface of the blanket 100 to evaporate water or solvent in the ink. The heated air source 206 may direct heated air over the ink to supplement the evaporation of the water or solvent from the ink. In at least one embodiment, the dryer 206 may be a heated air source with the same design as the dryer 296. While the dryer 206 may be positioned along the process direction to dry the hydrophilic composition, the dryer 206 may also be positioned along the process direction after the printhead modules 234A-234D to at least partially dry the aqueous ink on the blanket 100. The air may then be collected and evacuated by air returns 207A and 207B to reduce the interference of the air flow with other components in the printing area.

The printer 200 may further include a print medium supply and handling system 240 that stores, for example, one or more stacks of paper print mediums of various sizes. The print medium supply and handling system 240, for example, includes sheet or substrate supply sources 242, 244, 246, and 248. The supply source 248 may be a high capacity paper supply or feeder for storing and supplying image receiving substrates in the form of cut print mediums 249. The print medium supply and handling system 240 may also include a substrate handling and transport system 250 that has a media pre-conditioner assembly 252 and a media post-conditioner assembly 254. The printer 200 may also include a fusing device 260 to apply additional heat and pressure to the print medium after the print medium passes through the transfix nip 218. The printer 200 may also include an original document feeder 270 that has a document holding tray 272, document sheet feeding and retrieval devices 274, and a document exposure and scanning system 276.

Operation and control of the various subsystems, components, and functions of the printer 200 may be performed with the aid of the controller 280. The controller 80 may be operably connected to the intermediate transfer member 212, the printhead modules 234A-234D (and thus the printheads), the substrate supply and handling system 240, the substrate handling and transport system 250, and, in some embodiments, the one or more optical sensors 294A-294E. The controller 280 may be a self-contained, dedicated mini-computer having a central processor unit ("CPU") 282 with electronic storage 284, and a display or user interface ("UI") 286. The controller 80 may include a sensor input and control circuit 288 as well as a pixel placement and control circuit 289. In addition, the CPU 282 may read, capture, prepare, and manage the image data flow between image input sources, such as the scanning system 276, or an online or a work station connection 290, and the printhead modules 234A-234D. As such, the controller 80 may be the main multi-tasking processor for operating and controlling all of the other machine subsystems and functions.

Once an image or images have been formed on the blanket 100 and coating under control of the controller 280, the printer 200 may operate components within the printer 200 to perform a process for transferring and fixing the image or images from the blanket 100 to media. The controller 280 may operate actuators to drive one or more of the rollers 264 in the media transport system 250 to move the print medium 249 in the process direction P to a position adjacent the transfix roller 219 and then through the transfix nip 218 between the transfix roller 219 and the blanket 100. The transfix roller 219 may apply pressure against the back side of the print medium 249 in order to press the front side of the print medium 249 against the blanket 100 and the intermediate transfer member 212. Although the transfix roller 219 may also be heated, as shown, the transfix roller 219 is unheated in FIG. 2. The pre-heater assembly 252 for the print medium 249 may be in the media path leading to the transfix nip 218. The pre-conditioner assembly 252 may condition the print medium 249 to a predetermined temperature that aids in the transferring of the image to the media, thus simplifying the design of the transfix roller 219. The pressure produced by the transfix roller 219 on the back side of the heated print medium 249 may facilitate the transfixing (transfer and fusing) of the image from the intermediate transfer member 212 onto the print medium 249. The rotation or rolling of both the intermediate transfer member 212 and transfix roller 219 not only transfixes the images onto the print medium 249, but also assists in transporting the print medium 249 through the transfix nip 218. The intermediate transfer member 212 may continue to rotate to enable the printing process to be repeated.

After the intermediate transfer member moves through the transfix nip 218, the image receiving surface passes a cleaning unit that removes residual portions of the sacrificial polyurethane coating and small amounts of residual ink from the image receiving surface of the blanket 100. In the printer 200, the cleaning unit is embodied as a cleaning blade 295 that engages the surface of the blanket 100. The blade 295 is formed from a material that wipes the surface of the blanket 100 without causing damage to the blanket 100. For example, the cleaning blade 295 may be formed from a flexible polymer material in the printer 200. In another embodiment, the cleaning unit may include a roller or other member that applies a mixture of water and detergent to remove residual materials from the surface of the blanket 100 after the intermediate transfer member moves through the transfix nip 218. The term "detergent" or cleaning agent refers to any surfactant, solvent, or other chemical compound that is suitable for removing any sacrificial polyurethane coating and any residual ink from the image receiving surface of the blanket 100.

Figure 3:
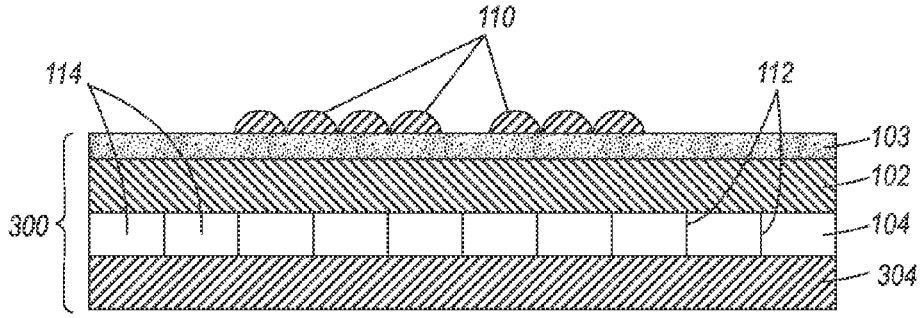
FIG. 3 is a schematic cross-sectional view of part of an intermediate transfer member belt or roll that includes a transfix blanket for a printer, according to one or more embodiments disclosed.
Figure 4:
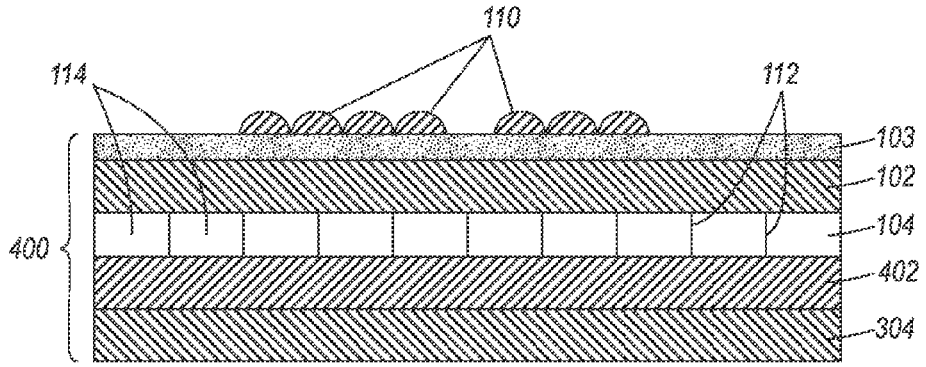
FIG. 4 is a schematic cross-sectional view of part of an intermediate transfer member belt or roll that includes a transfix blanket for a printer, according to one or more embodiments disclosed.

While FIG. 1 depicts an aqueous transfix blanket 100 attached to a rigid underlayer 107 that may be part of an intermediate transfer member such as an intermediate transfer roll 212, it will be understood that the aqueous transfix blanket 100 may form, in part or in whole, any of a rotating blanket, a rotating belt, or a rotating roll, for example as more particularly depicted in the cross sections of FIGS. 3 and 4. The rotating blanket, belt, or roll includes a screen layer 104 as described above with reference to FIGS. 1 and 2.

FIG. 3 depicts an intermediate transfer member blanket that may form part of an intermediate transfer member belt or roll 300 that includes, at least, a screen layer 104 and an outer conforming layer 102 as described above with reference to FIG. 1. The screen layer 104 and the outer conforming layer 102 alone may function sufficiently as a intermediate transfer member, specifically as a belt or roll. Optionally, the outer conforming layer 102 may have formed thereon at least one deposited layer 103 as described above for other embodiments.

Optionally, the belt or roll 300 may also include an inner support layer 304, for example an inner support layer including a polymer layer or a woven fiber. The inner support layer may include at least one of polyimide, a biaxially oriented polyethylene terephthalate polyester resin film such as Mylar® (available from DuPont), polyester, carbon fiber, a para-aramid synthetic fiber, a meta-aramid material, a metal, a metal alloy, and combinations of two or more of these. A polymer inner support layer 304 may have a thickness of from about 60 μm to about 100 μm, or from about 70 μm to about 90 μm, or about 80 μm. A fiber inner support layer 304 may have a thickness of from about 100 μm to about 1 mm, or from about 200 μm to about 700 μm, or from about 300 μm to about 500 μm.

FIG. 4 depicts an intermediate transfer member blanket that may form part of an intermediate transfer member belt or roll 400. The intermediate transfer member 400 may include a deposited layer 103, an outer conforming layer 102, a screen layer 104, and an inner support layer 304 as above. Additionally, the intermediate transfer member 400 may include an elastomer nip forming layer 402 interposed between the screen layer 104 and the inner support layer 304. The elastomer nip forming layer can include an elastomer such as silicone, a fluoro rubber such as Viton® (available from DuPont), ethylene propylene diene monomer (EPDM), nitrile rubber (i.e., acrylonitrile butadiene rubber or NBR), polyurethane, and combinations of two or more of these. If used, the elastomer nip forming layer may assist with the surface conforming to rough papers and ink layers. The elastomer nip forming layer may have a thickness of from about 20 micrometers (μm) to about 5,000 μm, or from about 40 μm to about 2,500 μm, or from about 100 μm to about 1,000 μm.

Figure 5:
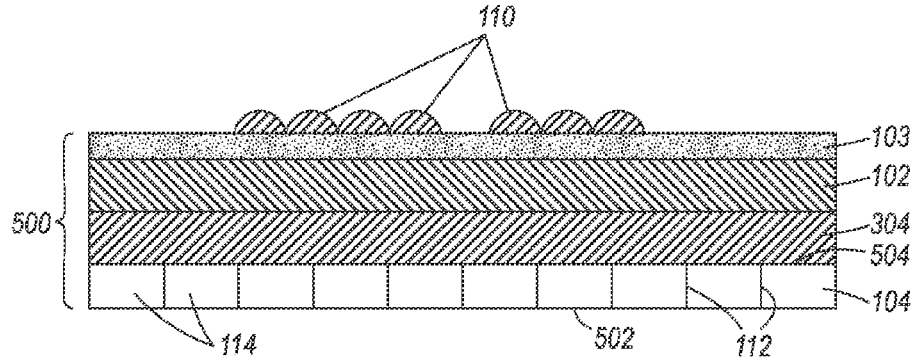
FIG. 5 is a schematic cross-sectional view of part of an intermediate transfer member belt or roll that includes a transfix blanket for a printer, according to one or more embodiments disclosed.

FIG. 5 depicts another embodiment of an aqueous transfix blanket 500 that has been prepared for attachment to an underlying substrate (not depicted for simplicity). FIG. 5 depicts an optional deposited layer 103, an outer conforming layer 102, an inner support layer 304, and a screen layer 104, with each layer in accordance with analogous layers 102, 103, 304, and 104 as described above. In an embodiment, the screen layer 104 may be attached to a rigid or flexible underlying substrate below the screen layer 104 using an adhesive 502 as depicted, or the screen layer 104 may be molded onto the underlying substrate. The screen layer 104 may be attached to the inner support layer 304 using, for example, a thin double-sided, high temperature adhesive tape or film 504.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. An aqueous transfix blanket, comprising:

a screen layer comprising fiberglass and having a thickness of from 200 μm to 300 μm, and further comprising a plurality of mesh wires that define a plurality of spaces between the plurality of mesh wires, the plurality of mesh wires having a pitch of from 1.5 mm to 2.5 mm in an X-direction and a pitch of from 1.5 mm to 2.5 mm in a Y-direction;

a first layer overlying the screen layer; and a second layer underlying the screen layer, wherein the plurality of spaces provide a plurality of air gaps between the first layer overlying the screen layer and the second layer underlying the screen layer.

2. The aqueous transfix blanket of claim 1, wherein the screen layer further comprises a material selected from the group consisting of carbon fiber, a para-aramid synthetic fiber, a meta-aramid material, a metal, a metal alloy, and combinations of two or more of these.

3. The aqueous transfix blanket of claim 2, wherein:

the first layer overlying the screen layer is an elastomer; and the second layer underlying the screen layer is a polymer.

4. The aqueous transfix blanket of claim 1, further comprising an ink layer over a surface of the first layer.

5. The aqueous transfix blanket of claim 4, further comprising a sacrificial coating on the surface of the first layer, wherein the sacrificial coating is interposed between the ink layer and the first layer.

6. The aqueous transfix blanket of claim 4, further comprising a deposited layer on the surface of the first layer, wherein the deposited layer comprises at least one of a synthetic rubber and fluoropolymer elastomer and a FKM material.

7. An aqueous transfix printer, comprising:

an aqueous transfix blanket, comprising:

a screen layer comprising fiberglass and having a thickness of from 200 μm to 300 μm, and further comprising a plurality of mesh wires that define a plurality of spaces between the plurality of mesh wires, the plurality of mesh wires having a pitch of from 1.5 mm to 2.5 mm in an X-direction and a pitch of from 1.5 mm to 2.5 mm in a Y-direction;

a first layer overlying the screen layer; and a second layer underlying the screen layer, wherein the plurality of spaces provide a plurality of air gaps between the first layer overlying the screen layer and the second layer underlying the screen layer; and a transfix roller; and a transfix nip at an interface between the aqueous transfix blanket and the transfix roller.

8. The aqueous transfix printer of claim 7, wherein the screen layer comprises a material selected from the group consisting of carbon fiber, a para-aramid synthetic fiber, a meta-aramid material, a metal, a metal alloy, and combinations of two or more of these.

9. The aqueous transfix printer of claim 7, wherein:

the first layer overlying the screen layer is an elastomer; and the second layer underlying the screen layer is a polymer.

10. The aqueous transfix printer of claim 7, further comprising an ink layer over a surface of the first layer.

11. The aqueous transfix printer of claim 10, further comprising a sacrificial coating on the surface of the first layer, wherein the sacrificial coating is interposed between the ink layer and the first layer.

12. The aqueous transfix printer of claim 7, further comprising:

an intermediate transfer member comprising a stainless steel substrate and an aluminum drum, wherein the aqueous transfix blanket is attached to the stainless steel substrate and the stainless steel substrate is attached to the aluminum drum.

13. The aqueous transfix printer of claim 7, wherein the aqueous transfix blanket further comprises a deposited layer on the surface of the first layer, wherein the deposited layer comprises at least one of a synthetic rubber and fluoropolymer elastomer and a FKM material.

* * * * *